United States Patent [19]

Tosaki et al.

[11] 4,347,166

[45] Aug. 31, 1982

[54] THERMISTOR COMPOSITION

[75] Inventors: Hiromi Tosaki; Hideo Arima; Teruo Mozume; Akira Ikegami, all of Yokohama; Tokio Isogai; Ichiro Tsubokawa, both of Fujisawa, all of Japan

[73] Assignee: Hitachi, Ltd., Tokyo, Japan

[21] Appl. No.: 14,276

[22] Filed: Feb. 22, 1979

[30] Foreign Application Priority Data

Feb. 22, 1978 [JP] Japan ..... 53/18461

[51] Int. Cl.[3] ..... H01B 1/06

[52] U.S. Cl. ..... 252/519; 252/518; 338/22 R

[58] Field of Search ..... 252/519, 518, 514; 338/22 R, 22 SD

[56] References Cited

U.S. PATENT DOCUMENTS

| | | | |
|---|---|---|---|
| 2,674,583 | 4/1954 | Christensen | 252/519 |
| 2,694,050 | 11/1954 | Loman | 252/519 |
| 3,015,633 | 1/1962 | Humbert et al. | 252/519 |
| 3,932,312 | 1/1976 | Kazmierowicz | 252/518 |
| 3,958,209 | 5/1976 | Sada | 252/518 |
| 3,960,778 | 6/1976 | Bouchard et al. | 252/519 |
| 4,160,227 | 7/1979 | Ikegami et al. | 252/514 |

*Primary Examiner*—J. L. Barr

*Attorney, Agent, or Firm*—Craig and Antonelli

[57] ABSTRACT

A thermistor composition comprises oxide powder of at least two of Mn, Co, and Ni, and an oxide powder of Ru as a noble metal.

8 Claims, 1 Drawing Figure

FIGURE
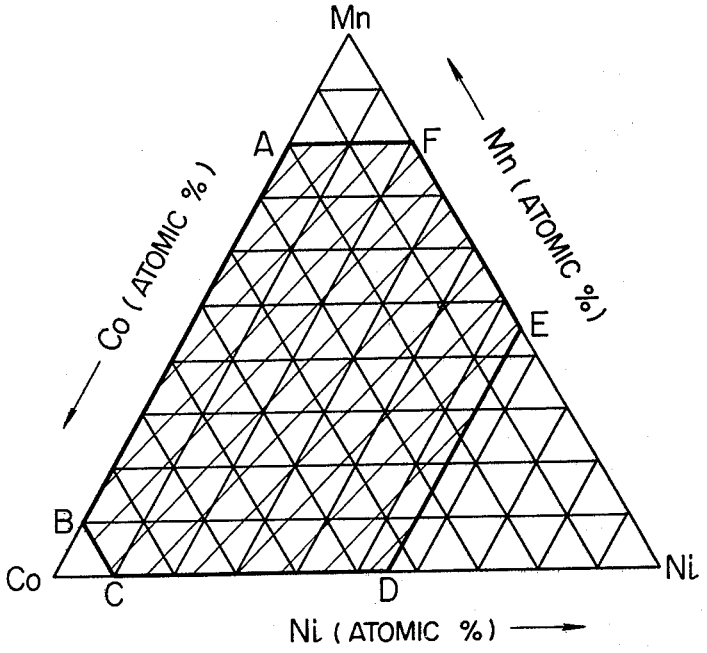

THERMISTOR COMPOSITION

BACKGROUND OF THE INVENTION

1. FIELD OF THE INVENTION

This invention relates to a novel thermistor composition.

2. DESCRIPTION OF THE PRIOR ART

Compound metal oxides of spinel structure obtained by mixing at least two of oxides of Mn, Co, Ni, Fe, Al and Cu and firing the resulting mixture at 900°-1,300° C., thereby conducting a solid phase reaction are known as thermistor materials having a resistance of negative gradient to temperature and a large change in resistance by temperature, that is, a large thermistor constant. Said compound metal oxides are now used as materials for disc-form thermistor element and bead-form thermistor element owing to (i) their large thermistor constant and (ii) their easier production. Above all, compound metal oxides containing copper oxide has such an additional characteristic as (iii) a low specific resistance besides said characteristics (i) and (ii), and thus are used as materials for thermistor of low resistance. However, the compound metal oxides containing the copper oxide undergo a change in resistance with time of more than 10%, and thus have a poor stability, and cannot be used for temperature detection element and temperature compensation element with a high precision.

As thermistor materials containing oxide of Ru, compound metal oxides of pyrochlore structure (compound metal oxides of Cd, Bi, Nb and Ru) are known, but require firing at 1,200° C. for 16 hours. (Japanese Laid-open Patent Application Specification No. 118,295/75).

SUMMARY OF THE INVENTION

An object of the present invention is to provide a thermistor composition being freed from said disadvantages of the prior art, and having such characteristics that (i) firing can be completed for a few hours, and the resulting thermistor material has (ii) a large thermistor constant, for example, 500 K or more, (iii) a low specific resistance, for example, less than 5,300, and (iv) a small change in resistance with time, for example, less than 2.5%.

As a result of various studies, the present inventors have found that a powdery mixture comprising oxide powders of at least two of Mn, Co, and Ni, and oxide powder of Ru can attain said object. That is, said powdery mixture can be converted to a thermistor material of spinel structure by firing for a few hours.

A mixing proportion of metal oxide powders of at least two of Mn, Co, and Ni is preferably within an area enclosed by lines A-B-C-D-E-F in a triangular diagram on FIGURE in the accompanying drawing, where points A, B, C, D, E, and F have the following compositions:

| | Mn (% by atom) | Ni (% by atom) | Co (% by atom) |
|---|---|---|---|
| A | 80 | 0 | 20 |
| B | 10 | 0 | 90 |
| C | 0 | 10 | 90 |
| D | 0 | 55 | 45 |
| E | 45 | 55 | 0 |
| F | 80 | 20 | 0 |

The amount of oxide powder of Ru is preferably 0.5-40% by atom on the basis of total metal components contained in total of the metal oxide powders of at least two of Mn, Co and Ni, and the oxide powder of Ru.

When the composition is outside said range, a thermistor composition meeting the object of the present invention cannot be obtained. The present invention can be completed, irrespective of whether oxide powders of Al and Fe are contained or not in the present composition.

BRIEF DESCRIPTION OF THE DRAWING

FIGURE is a triangular diagram showing a mixing proportion of oxides of Mn, Co and Ni in % by atom.

DETAILED DESCRIPTION OF PREFERRED EMBODIMENT

The present invention will be described in detail, referring to Examples.

EXAMPLE 1

$MnO_2$ powder, CoO powder and $RuO_2$ powder were weighed out as given in Table 1, Nos. 2-11, and the powders were milled and mixed in an agate mortar for 4 hours for the individual batches. The resulting powdery mixtures were placed individually in alumina crucibles and preliminarily fired at 900° C. for 2 hours to proceed with some solid phase reaction. The preliminarily fired powdery mixtures were further milled and pulverized individually in an agate mortar for 4 hours. Pellets, 12.0 mm in diameter and 3.0 mm in thickness were prepared from the resulting powders by applying a pressure of 3.0 tons/cm$^2$ to the powders. The resulting pellets were fired at 1,250° C. for 2 hours to complete the solid phase reaction, whereby thermistors of compound metal oxides of spinel structure were prepared. Electrodes were formed on both sides of pellet-form thermistor with an electro-condictive paint, and a thermistor constant, resistance and change in resistance when left standing at 150° C. for 2,000 hours were measured. The results are shown in Table 1, Nos. 2-11, thermistor characteristic column. In Table 1, No. 1 is the well known thermistor material of the prior art and its composition and characteristics are given therein for comparative purpose.

Nos. 2-11 of Table 1 show the characteristics meeting the object of the present invention.

TABLE 1

| | Metal components in thermistor composition, % by atom | | | Thermistor characteristics | | |
|---|---|---|---|---|---|---|
| | | | | Specific resistance | Thermistor constant | Change in |
| No. | Mn | Co | Ru | $\rho(\Omega \cdot cm)$ | B(K) | resistance |
| 1 | 33 | 67 | 0 | 1000 | 4000 | +3.0 |
| 2 | 32.8 | 67 | 0.5 | 800 | 3800 | +2.3 |
| 3 | 32 | 67 | 1 | 500 | 3400 | +2.3 |
| 4 | 30 | 67 | 3 | 140 | 3200 | +2.1 |
| 5 | 25 | 67 | 8 | 20 | 2700 | +1.8 |
| 6 | 20 | 67 | 13 | 12 | 2550 | +1.6 |
| 7 | 17 | 67 | 16 | 5 | 2500 | +1.2 |
| 8 | 13 | 67 | 20 | 4 | 2500 | +1.5 |
| 9 | 8 | 67 | 25 | 3 | 2500 | +1.0 |
| 10 | 48 | 17 | 35 | 2 | 1530 | +1.6 |
| 11 | 30 | 30 | 40 | 1 | 510 | +1.3 |

EXAMPLE 2

From $Mn_3O_4$ powder, $Co_3O_4$ powder, NiO powder and $RuO_2$ powder as starting materials were prepared pellet-form thermistors having compositions shown in Table 2, Nos. 2-16 in the same manner as in Example 1, and their characteristics were measured in the same manner as in Example 1. Results are given in Table 2, Nos. 2-16, thermistor characteristic column. In Table 2, No. 1 is the well known thermistor material of the prior art, and its composition and characteristics are given therein for comparative purpose.

Nos. 2-15 in Table 2 show the characteristics meeting the object of the present invention, and No. 16 shows the characteristics failing to meet the object of the present invention.

TABLE 2

| | Metal components in thermistor composition, % by atom | | | | Thermistor characteristics | | |
|---|---|---|---|---|---|---|---|
| | | | | | Specific resistance | Thermistor constant | Change in resistance |
| No. | Mn | Co | Ni | Ru | ρ(Ω · cm) | B(K) | (%) |
| 1 | 50 | 33 | 17 | 0 | 600 | 3400 | +1.3 |
| 2 | 50 | 32.5 | 17 | 0.5 | 400 | 3200 | +1.1 |
| 3 | 50 | 30 | 17 | 3 | 170 | 2900 | +1.0 |
| 4 | 50 | 28 | 17 | 5 | 110 | 2830 | +0.8 |
| 5 | 50 | 26 | 17 | 7 | 56 | 2740 | +0.8 |
| 6 | 50 | 25 | 17 | 8 | 28 | 2500 | +0.9 |
| 7 | 45 | 23 | 17 | 15 | 6 | 2100 | +0.5 |
| 8 | 45 | 33 | 17 | 5 | 120 | 2900 | +1.2 |
| 9 | 40 | 33 | 17 | 10 | 20 | 2400 | +1.3 |
| 10 | 33 | 33 | 17 | 17 | 5 | 1900 | +1.0 |
| 11 | 50 | 33 | 8 | 9 | 92 | 2570 | +1.1 |
| 12 | 46 | 33 | 4 | 17 | 10 | 2200 | +1.0 |
| 13 | 40 | 32 | 8 | 20 | 10 | 1540 | +0.8 |
| 14 | 30 | 37 | 8 | 25 | 8 | 1210 | +0.6 |
| 15 | 25 | 27 | 8 | 40 | 5 | 780 | +0.4 |
| 16 | 25 | 27 | 8 | 42 | 3 | 480 | +0.4 |

EXAMPLE 3

From $MnO_2$ powder, $Co_3O_4$ powder, $Fe_2O_3$ powder, and $RuO_2$ powder as starting materials were prepared pellet-form thermistors having compositions given in Table 3, Nos. 2-9 in the same manner as in Example 1, and their characteristics were measured in the same manner as in Example 1. Results are given in Table 3, Nos. 2-9, thermistor characteristic column. In Table 3, No. 1 is the well known thermistor material of the prior art, and its composition and characteristics are given therein for comparative purpose.

Nos. 2-9 in Table 3 show characteristics meeting the object of the present invention.

TABLE 3

| | Metal components in thermistor composition, % by atom | | | | Thermistor characteristics | | |
|---|---|---|---|---|---|---|---|
| | | | | | Specific resistance | Thermistor constant | Change in resistance |
| No. | Mn | Co | Fe | Ru | ρ(Ω · cm) | B(K) | (%) |
| 1 | 45 | 50 | 5 | 0 | 1100 | 3920 | +1.5 |
| 2 | 45 | 49.5 | 5 | 0.5 | 700 | 3560 | +1.4 |
| 3 | 44 | 48 | 5 | 3 | 240 | 3160 | +1.3 |
| 4 | 40 | 45 | 5 | 10 | 17 | 2540 | +1.2 |
| 5 | 38 | 42 | 5 | 15 | 6.8 | 2380 | +1.2 |
| 6 | 36 | 39 | 5 | 20 | 4.3 | 2350 | +1.0 |
| 7 | 31 | 34 | 5 | 30 | 3.5 | 2310 | +0.8 |
| 8 | 36 | 24 | 5 | 35 | 2.9 | 1860 | +0.6 |
| 9 | 36 | 19 | 5 | 40 | 2.0 | 780 | +0.4 |

EXAMPLE 4

From $MnO_2$ powder, NiO powder, $Al_2O_3$ powder and $RuO_2$ powder as starting materials were prepared pellet-form thermistors having compositions given in Table 4, Nos. 2-9, in the same manner as in Example 1, and their characteristics were measured in the same manner as in Example 1. Results are given in Table 4, Nos. 2-9, thermistor characteristic column. In Table 4, No. 1 is the well known thermistor material of the prior art, and its composition and characteristics are given therein for a comparative purpose.

Nos. 2-9 in Table 4 show characteristics meeting the object of the present invention.

TABLE 4

| | Metal components in thermistor composition, % by atom | | | | Thermistor characteristics | | |
|---|---|---|---|---|---|---|---|
| | | | | | Specific resistance | Thermistor constant | Change in resistance |
| No. | Mn | Ni | Al | Ru | ρ(Ω · cm) | B(K) | (%) |
| 1 | 77 | 20 | 3 | 0 | 7400 | 3950 | +3.0 |
| 2 | 76.5 | 20 | 3 | 0.5 | 5300 | 3890 | +2.5 |
| 3 | 75 | 19 | 3 | 3 | 620 | 3870 | +2.5 |
| 4 | 69 | 18 | 3 | 10 | 66 | 3120 | +2.5 |
| 5 | 65 | 17 | 3 | 15 | 20 | 2730 | +2.0 |
| 6 | 61 | 16 | 3 | 20 | 12 | 2490 | +1.4 |
| 7 | 53 | 14 | 3 | 30 | 8.2 | 2050 | +1.0 |
| 8 | 40 | 12 | 3 | 35 | 1.7 | 1230 | +0.8 |
| 9 | 42 | 15 | 3 | 40 | 0.8 | 860 | +0.8 |

As described above, a thermistor having (i) a high thermistor constant, (ii) a low specific resistance, and (iii) a small change in resistance with time, i.e. a high stability can be prepared from the present thermistor composition. In the present thermistor composition, a solid phase reaction can be completed by firing at 1,250° C. for 2 hours, and a thermistor of compound metal oxide of spinel structure can be obtained thereby.

What is claimed is:

1. A thermistor material, which comprises a spinel complex metal oxide of a fired mixture of powder of manganese oxide and powder of ruthenium oxide with at least one of powder of cobalt oxide and powder of nickel oxide, the spinel complex metal oxide containing 0.5–40% by atom of ruthenium atom.

2. A thermistor material, which comprises a spinel complex metal oxide of a fired mixture of powder of manganese oxide and powder of ruthenium oxide with at least one of powder of cobalt oxide and powder of nickel oxide, the spinel complex oxide containing manganese atom, cobalt atom and nickel atom within the area defined by lines A-B-C-D-E-F in the triangular diagram in the accompanying FIGURE, a total content of the manganese, cobalt and nickel atoms being 60–99.5% by atom, the balance being 0.5–40% by atom of ruthenium atom.

3. A thermistor material which comprises a spinel complex metal oxide of a fired mixture of powder of manganese oxide, powder of ruthenium oxide, powder of cobalt oxide, and powder of iron oxide, the spinel complex metal oxide containing 0.5–40% by atom of ruthenium atom.

4. A thermistor material which comprises a spinel complex metal oxide of fired mixture of powder of manganese oxide, powder of ruthenium oxide, powder of cobalt oxide and powder of iron oxide, the spinel complex metal oxide containing manganese atom and cobalt atom on the line A–B in the triangular diagram in the accompanying FIGURE, a total content of the manganese and cobalt atoms being 55–94.5% by atom, that of ruthenium atom being 0.5–40% by atom, and that of iron atom being 5% by atom.

5. A thermistor material which comprises a spinel complex metal oxide of a fired mixture of powder of manganese oxide, powder of ruthenium oxide, powder of nickel oxide, and powder of aluminum oxide, the spinel complex metal oxide containing 0.5–40% by atom of ruthenium atom.

6. A thermistor material which comprises a spinel complex metal oxide of a fired mixture of powder of manganese oxide, powder of ruthenium oxide, powder of nickel oxide, and powder of aluminum oxide, the spinel complex metal oxide containing manganese atom and nickel atom on the line E–F in the triangular diagram in the accompanying FIGURE, a total content of the manganese and nickel atoms being 57–96.5% by atom, that of ruthenium atom being 0.5–40% by atom, and that of aluminum atom being 3% by atom.

7. A thermistor material, which comprises a spinel complex metal oxide of a fired mixture of at least two of powder of manganese oxide, powder of cobalt oxide and powder of nickel oxide, and powder of ruthenium oxide, the spinel complex metal oxide containing 0.5–40% by atom of ruthenium atom.

8. A thermistor material, which comprises a spinel complex metal oxide of a fired mixture of at least two of powder of manganese oxide, powder of cobalt oxide and powder of nickel oxide, the spinel complex metal oxide containing at least two of manganese atom, cobalt atom and nickel atom within the area defined by lines A–B–C–D–E–F in the triangular diagram in the accompanying FIGURE, and powder of ruthenium oxide, a total content of the at least two of manganese, cobalt and nickel atoms being 60–99.5% by atom, the balance being 0.5–40% by atom of ruthenium atom.

* * * * *